US005490294A

United States Patent [19]

Kramer

[11] Patent Number: 5,490,294

[45] Date of Patent: Feb. 13, 1996

[54] SLEEPING BAG WITH REMOVABLE BAG LINER

[75] Inventor: Paul F. Kramer, Berkeley, Calif.

[73] Assignee: Mountian Hardwear, Inc., Berkeley, Calif.

[21] Appl. No.: 349,395

[22] Filed: Dec. 5, 1994

[51] Int. Cl.[6] ..... A47G 9/08; A47C 29/00

[52] U.S. Cl. ..... 5/413; 2/69.5

[58] Field of Search ..... 5/413, 486, 496, 5/502; 2/69.5

[56] References Cited

U.S. PATENT DOCUMENTS

| | | | |
|---|---|---|---|
| 2,594,438 | 4/1952 | Howe | 5/413 |
| 3,584,323 | 6/1971 | Worley | 5/413 |
| 5,343,578 | 9/1994 | Kettenhofen | 5/413 |
| 5,386,602 | 2/1995 | Krenzler | 5/413 |

*Primary Examiner*—Steven N. Meyers
*Assistant Examiner*—Robert Santos
*Attorney, Agent, or Firm*—Thomas R. Lampe

[57] ABSTRACT

A zipper assembly is used to releasably attach a bag liner to a sleeping bag to retain the bag liner within the sleeping bag and to expand the bag interior to compensate for volume lost by insertion of the bag liner. The zipper assembly includes first and second pairs of spaced rows of liner zipper teeth. Two rows are secured to the existing rows of bag zipper teeth by two zipper slides. A third zipper slide releasably secures two of the other rows of liner zipper teeth to permit an individual to enter and exit the bag liner. In another embodiment of the invention, a protective cover is releasably secured to a bag by a zipper assembly.

14 Claims, 7 Drawing Sheets

SLEEPING BAG WITH REMOVABLE BAG LINER

TECHNICAL FIELD

This invention relates to sleeping bag apparatus. More particularly, the invention is directed to a sleeping bag with a removable bag liner.

BACKGROUND ART

It is well known in the sleeping bag art to employ inner liners which contribute to the comfort and warmth of a bag occupant. In addition, use of a liner can extend the life of a bag by eliminating the need to wash it as frequently. Some state laws require sleeping bag rental businesses to wash their bags after every use or to supply washable, removable liners.

It is known in the prior art to temporarily secure bag liners in place through the use of string or ribbon ties and zippers. Zippers are highly effective for such purpose but prior art zipper connectors for sleeping bags and liners have drawbacks.

With prior art zipper interconnects for sleeping bags and bag liners, the liner effectively reduces the interior size of the bag by occupying space within the inner chamber thereof that would otherwise be available to the occupant. Simply stated, the user of the sleeping bag has less room available to him or her with a liner than when the bag does not employ a liner. This reduction in size can be fairly substantial if the bag liner is relatively bulky.

Another problem that presents itself in prior art bag liner constructions is deployment of the liner interconnect zipper construction within the confines of the bag. This can be a source of discomfort to the bag occupant.

DISCLOSURE OF INVENTION

The present invention relates to apparatus which incorporates a zipper assembly to interconnect a sleeping bag and a bag liner. Through utilization of the present invention the inner liner performs the conventional inner liner task of adding warmth to the bag. However, in contrast to prior art arrangements, apparatus constructed in accordance with the teachings of the present invention adds extra width to the bag to make up for any "lost" room due to additional liner fabric and insulation inside the bag. That is, use of the liner will not constrict or lessen the effective volume of the sleeping bag inner chamber to the extent of prior art liner securing means employing zippers. Furthermore, the zipper assembly employed when practicing the teachings of the present invention is not disposed within the normal confines of the sleeping bag and thus will not be a source of discomfort to the user.

The sleeping bag utilized when practicing the teachings of the present invention defines a bag interior, a bag head opening, and a bag longitudinal opening extending longitudinally along the sleeping bag and communicating with the bag head opening and the bag interior. The bag longitudinal opening is defined by first and second spaced elongated bag edges.

The sleeping bag includes a first row of bag zipper teeth disposed along the first spaced elongated bag edge and a second row of bag zipper teeth disposed along the second spaced elongated bag edge.

A removable bag liner is positioned in the bag interior and defines a liner interior having a liner head opening and a liner longitudinal opening extending longitudinally along the bag liner and communicating with the liner head opening and the liner interior. The liner longitudinal opening is defined by first and second spaced elongated liner edges.

A zipper assembly is attached to the bag liner. The zipper assembly includes first and second pairs of spaced rows of liner zipper teeth. The first pair of spaced rows of liner zipper teeth is secured to the first spaced elongated liner edge and parallel thereto and the second pair of spaced rows of liner zipper teeth are secured to the second spaced liner edge and parallel thereto.

A first zipper slide is slidably disposed on and releasably interconnects the first row of bag zipper teeth and a row of liner teeth of the first pair of spaced rows of liner teeth. A second zipper slide is slidably disposed on and releasably interconnects the second row of bag zipper teeth and a row of liner teeth of the second pair of spaced rows of liner teeth. A third zipper slide is slidably disposed on and releasably interconnects adjacent rows of liner teeth of the first and second pairs of spaced rows of liner teeth between the rows of liner teeth releasably interconnected to the rows of bag zipper teeth. The zipper assembly releasably secures the bag liner to the sleeping bag.

The present invention also can be utilized to releasably secure a protective cover to a bag and provide bag expansion.

Other features, advantages, and objects of the present invention will become apparent with reference to the following description and accompanying drawings.

BEST MOPE FOR CARRYING OUT THE INVENTION

Figure 1:
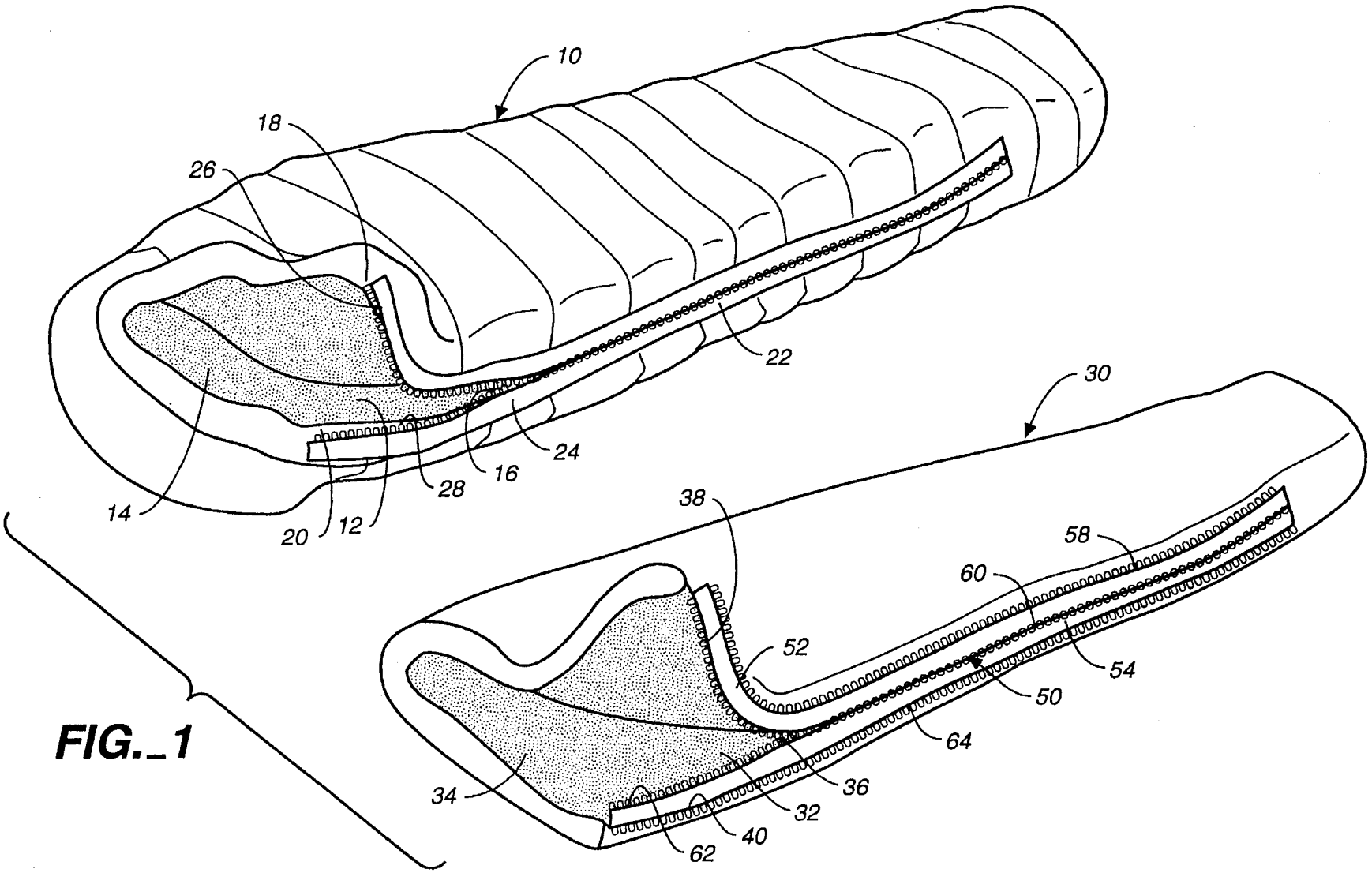
FIG. 1 is a perspective view of a sleeping bag and a bag liner constructed in accordance with the teachings of the present invention, the bag liner shown removed from the sleeping bag.

Referring now to FIGS. 1, 4, 4A, 5, and 7, apparatus constructed in accordance with the teachings of the present invention is illustrated.

In FIGS. 1, 4, 4A, and 5, reference numeral 10 designates a sleeping bag. Sleeping bag 10 defines a bag interior 12, a bag head opening 14, and a bag longitudinal opening 16 extending longitudinally along the sleeping bag and communicating with the bag head opening and the bag interior. Bag longitudinal opening 16 is defined by bag edges 18, 20.

A zipper strip or tape 22 is sewn and secured to bag edge 18 and extends therealong. Similarly, a bag zipper strip 24 is secured to bag edge 20 and extends therealong. A row of bag zipper teeth 26 is connected to zipper strip 22 and a row of bag zipper teeth 28 is connected to bag zipper strip 24.

The sleeping bag structure just described is of conventional construction, the particular sleeping bag 10 that is illustrated being what is known in the art as a mummy or mummy-type bag.

A removable bag liner incorporating the teachings of the present invention is designated by reference numeral 30. Bag liner 30 is for positioning in the bag interior 12 and defines a lining interior 32. Bag liner 30 includes a liner head opening 34 and a liner longitudinal opening 36 extending longitudinally along the bag liner and communicating with the liner head opening and the liner interior. Liner longitudinal opening 36 is defined by spaced elongated liner edges 38, 40.

Figure 7:
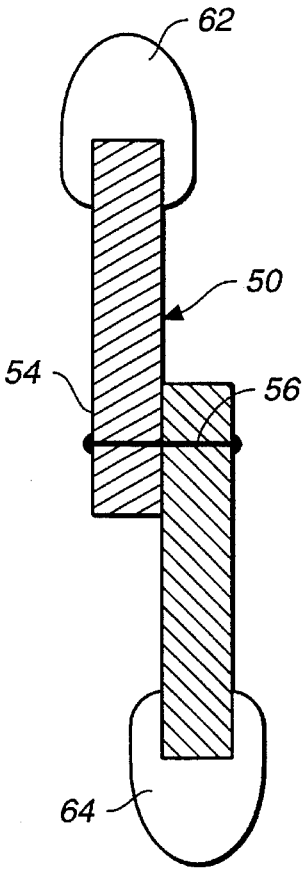
FIG. 7 is a view similar to FIG. 6 but illustrating a portion of the zipper assembly employed in the present invention and including two interconnected strips having zipper teeth at the distal ends thereof.
Figure 8:
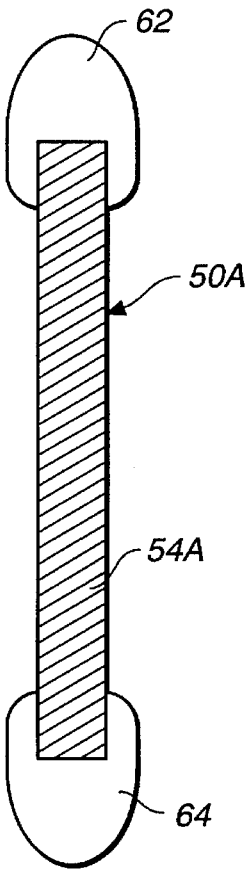
FIG. 8 is a view similar to FIG. 7 but illustrating an alternative embodiment of zipper strip and zipper teeth combination.

A zipper assembly 50 is attached to bag liner 30. Zipper assembly 50 includes an elongated zipper strip 52 stitched or otherwise secured to and extending lengthwise along liner edge 38 and an elongated liner zipper strip 54 secured to and extending lengthwise along liner edge 40. FIG. 7 illustrates in diagrammatic fashion one form of zipper strip, designated by reference numeral 54, which consists of two tapes having lapped ends and secured together by stitching 56. FIG. 8 shows an alternative arrangement wherein the zipper strip is of integral construction, comprising only a single tape or strip, being identified by reference numeral 54A.

Regardless of whether the FIG. 7 or FIG. 8 embodiment is employed, or even some other strip configuration is employed, an important aspect of the present invention resides in the fact that two spaced rows of liner zipper teeth are affixed to each strip 52, 54. Elongated liner stripper strip 52 has a row of liner zipper teeth 58 and a row of liner zipper teeth 60 disposed parallel to each other and extending along the length of the strip 52. In like fashion, elongated zipper strip 54 accommodates two parallel rows of liner zipper teeth 62, 64.

Figure 5:
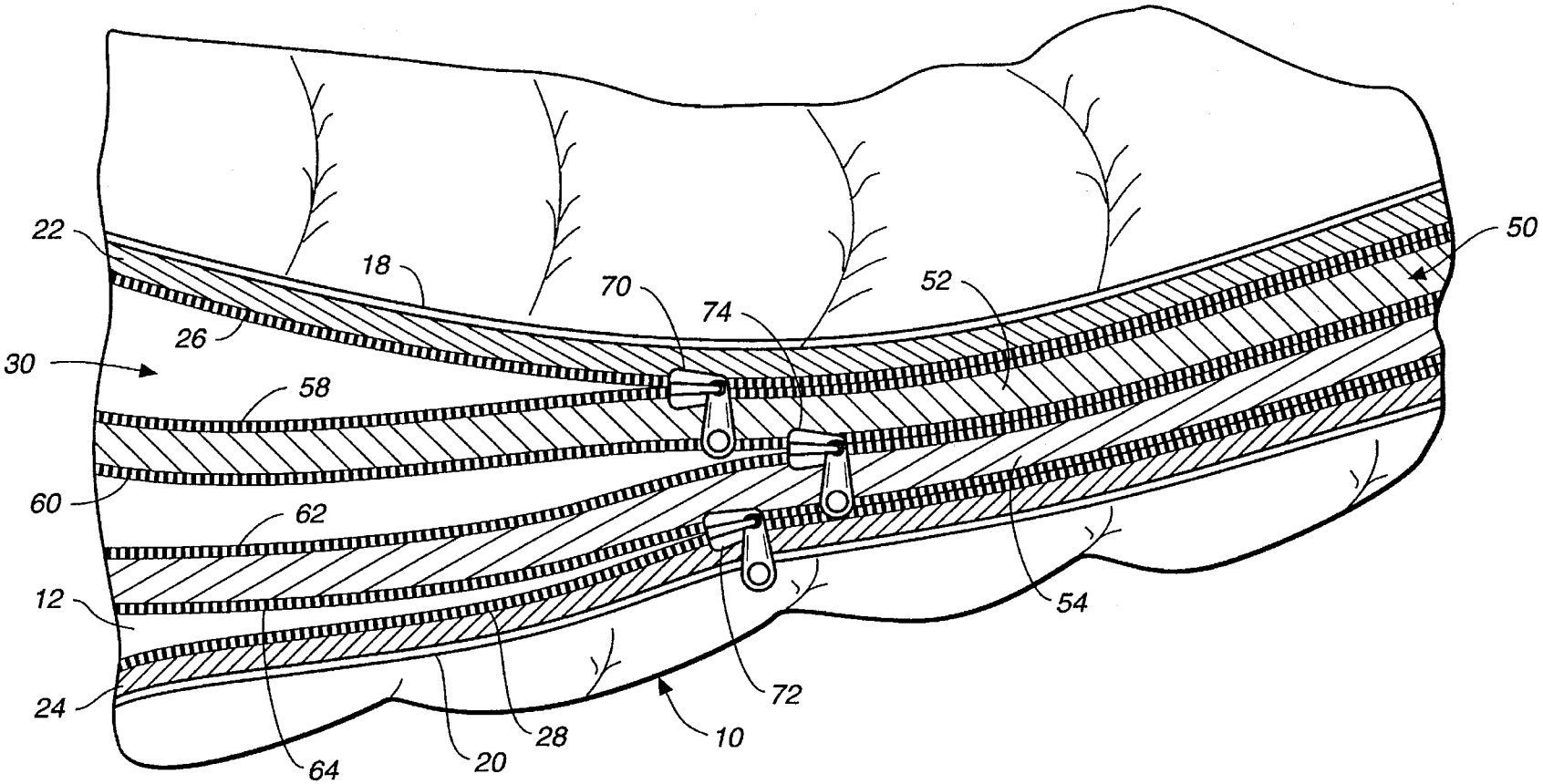
FIG. 5 is an enlarged, perspective view illustrating portions of a sleeping bag and bag liner constructed in accordance with the teachings of the present invention and illustrating details of a zipper assembly releasably securing the bag liner to the sleeping bag.

In FIG. 5, the bag liner 30 is positioned in the interior 12 of sleeping bag 10. The zipper assembly 50 is positioned between the rows of bag zipper teeth 26, 28.

The bag liner 30 is secured in place by zipping the zipper assembly into engagement with the rows of bag zipper teeth 26, 28. More particularly, a zipper slide 70 is slidably disposed on and releasably interconnects row of bag zipper teeth 26 to row of liner zipper teeth 58. Another zipper slide 72 is slidably disposed on and releasably interconnects row of liner zipper teeth 64 to row of bag zipper teeth 28. If desired, other ancillary connection means may be employed at other locations of the sleeping bag and bag liner to supplement the connection and further stabilize the positioning of the bag liner relative to the sleeping bag. For example, ties (not shown) may be employed and secured together at the other sides of the sleeping bag and bag liner. Such tie feature is known in the prior art and has not been illustrated.

Another zipper slide 74 is slidably disposed on and releasably interconnects rows of liner zipper teeth 60, 62 and is used to open the liner to facilitate ingress and egress by the sleeping bag's user.

Figure 2:
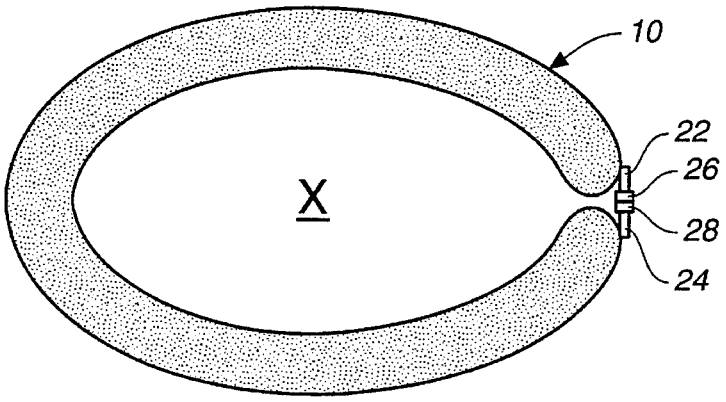
FIG. 2 (PRIOR ART)
FIGS. 2 and 2A are diagrammatic, sectional views of a conventional sleeping bag in closed and open conditions, respectively.

It is to be noted that the illustrated elongated liner zipper strips are of rectangular configuration, having parallel elongated liner zipper strip edges. The spaced rows of zipper liner teeth are, in the illustrated embodiment, located at the parallel elongated liner zipper strip edges. The elongated liner zipper strips are co-planar and extend between the rows of bag zipper teeth when the zipper assembly secures the bag liner to the sleeping bag. This results in an expansion of the bag which will compensate, to at least some degree, for the reduction of the effective size of the bag interior or inner chamber when the bag liner is placed into position. This is illustrated diagrammatically in FIG. 4 wherein it is seen that the edges of the sleeping bag are disposed apart a greater distance than is normally the case when the zipper assembly is in position. This provides a cavity of X dimension within the bag liner which approximates the X dimension of the sleeping bag interior without the liner as illustrated in FIG. 2 wherein no zipper assembly 50 is employed.

Figure 3:
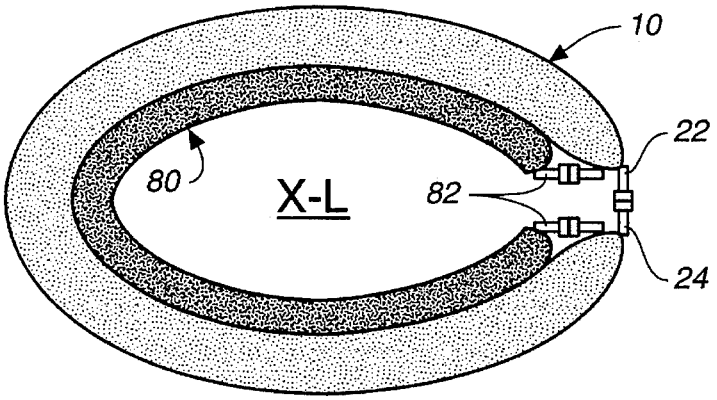
FIG. 3 (PRIOR ART)
FIGS. 3 and 3A are diagrammatic, sectional views of a prior art sleeping bag construction and a prior art bag liner disposed therein in closed and opened condition, respectively.
Figure 4:
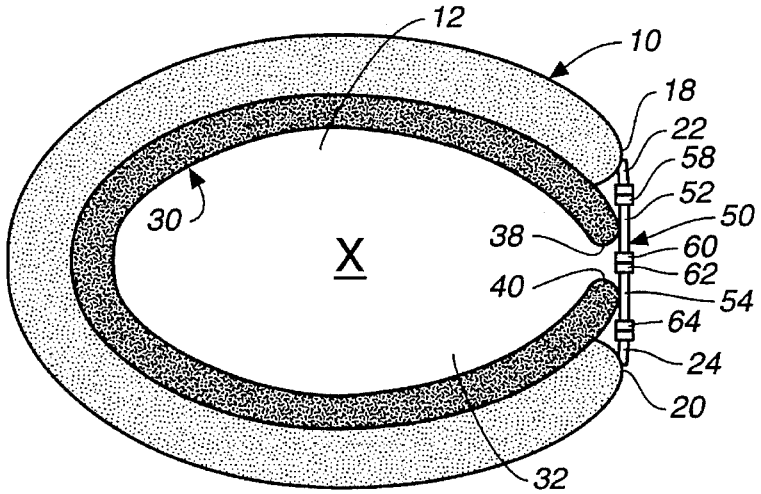
FIGS. 4 and 4A are views similar to FIGS. 3 and 3A, but illustrating the apparatus of the present invention.
Figure 2A:
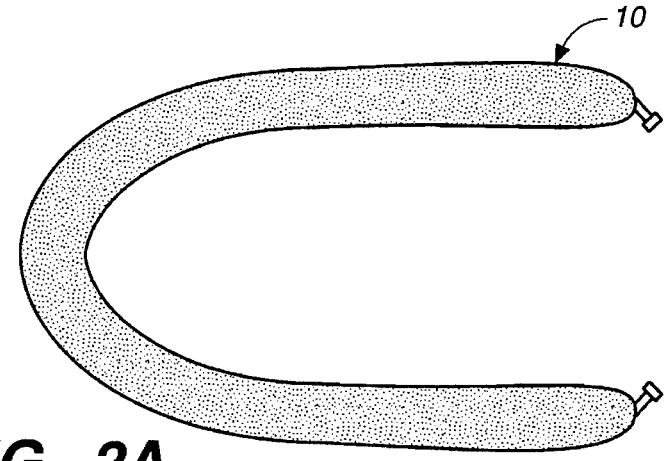
FIG. 2A (PRIOR ART)

FIG. 3 illustrates a conventional prior art approach for holding a bag liner 80 in a sleeping bag 10. In this prior art approach, the conventional zipper mechanism employed to close the sleeping bag has the teeth thereof secured together in the normal manner. The liner 80 is connected to sleeping bag 10 by two zippers 82 which have the tapes or strips thereof sewn to the liner bag edges and the sleeping bag edges so that the zippers 82 extend inwardly from the bag into the interior thereof. The volume of the bag 10 using the prior art approach shown in FIG. 3 effectively reduces the interior of the bag to a dimension equaling its normal dimension X minus the volume L taken up by the liner. Furthermore, the intrusion of the zipper structure 82 into the interior of the bag can create discomfort for the user.

Figure 3A:
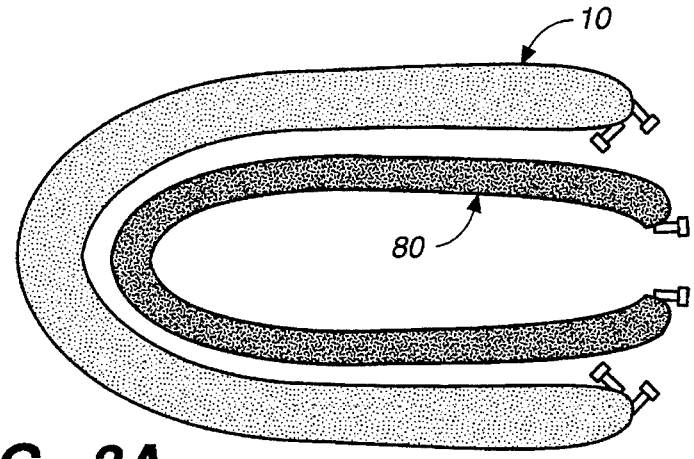
FIG. 3A (PRIOR ART)
Figure 4A:
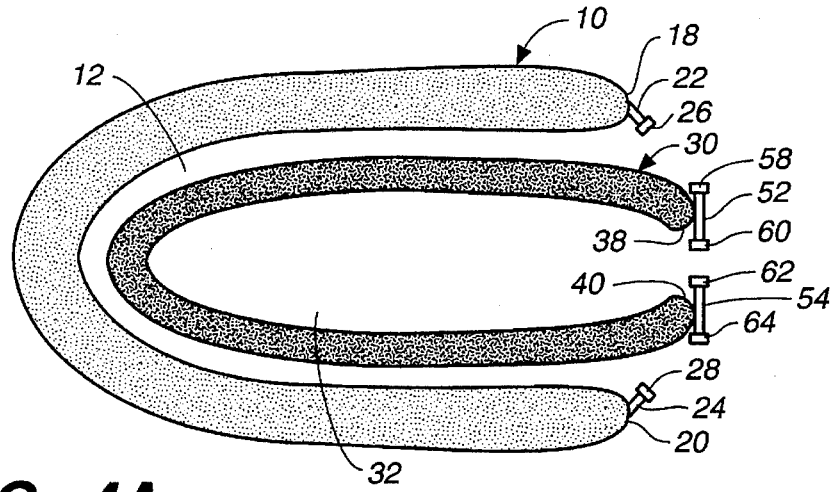
Figure 6:
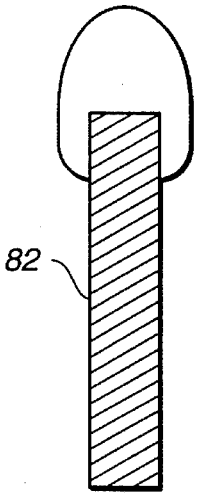
FIG. 6 (PRIOR ART)
FIG. 6 is a diagrammatic, greatly enlarged, sectional view illustrating a typical prior art zipper tooth and strip employed in prior art bag liner constructions.

FIG. 6 provides a diagrammatic illustration of one-half of a conventional zipper 82. FIG. 3A shows the components of the zipper 82 separated. It will be noted that a portion of the zipper 82 remains within the interior of the bag even after the liner 80 is removed therefrom. Thus, a potentially irritating or discomforting portion of the zipper 82 will be associated with the sleeping bag whether or not the liner is in place.

It is apparent from the above description that the present invention allows ready retrofit of existing bags to accommodate a liner and provide bag expansion to compensate for the liner.

Figure 9:
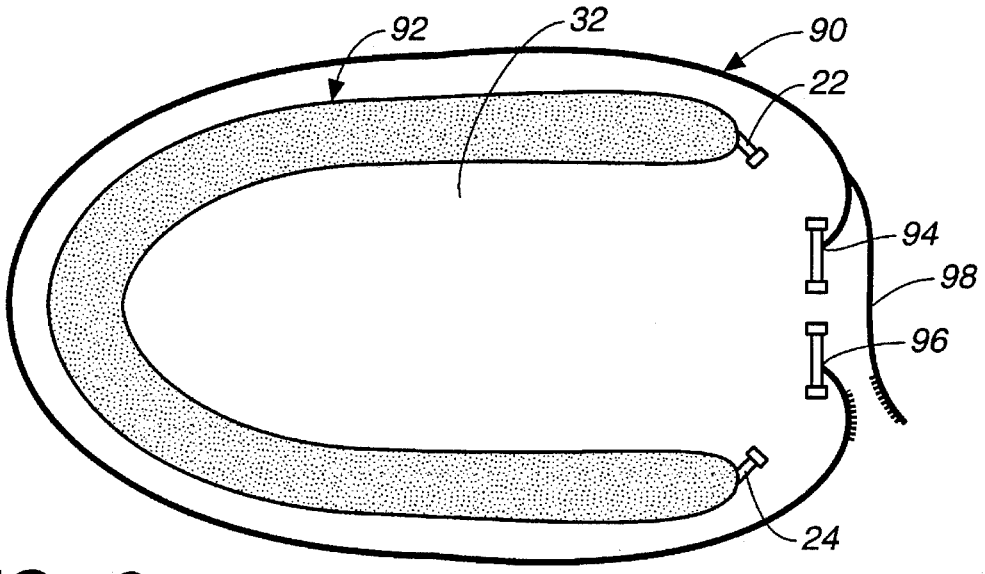
FIG. 9 and 9A are diagrammatic, sectional views of an alternative form of the present invention including a protective cover secured about an inner bag.
Figure 9A:
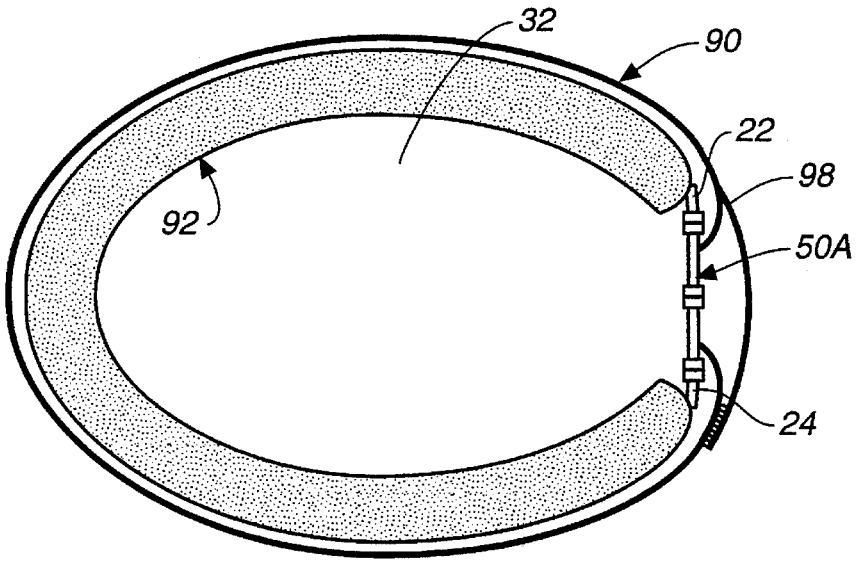
Figure 10:
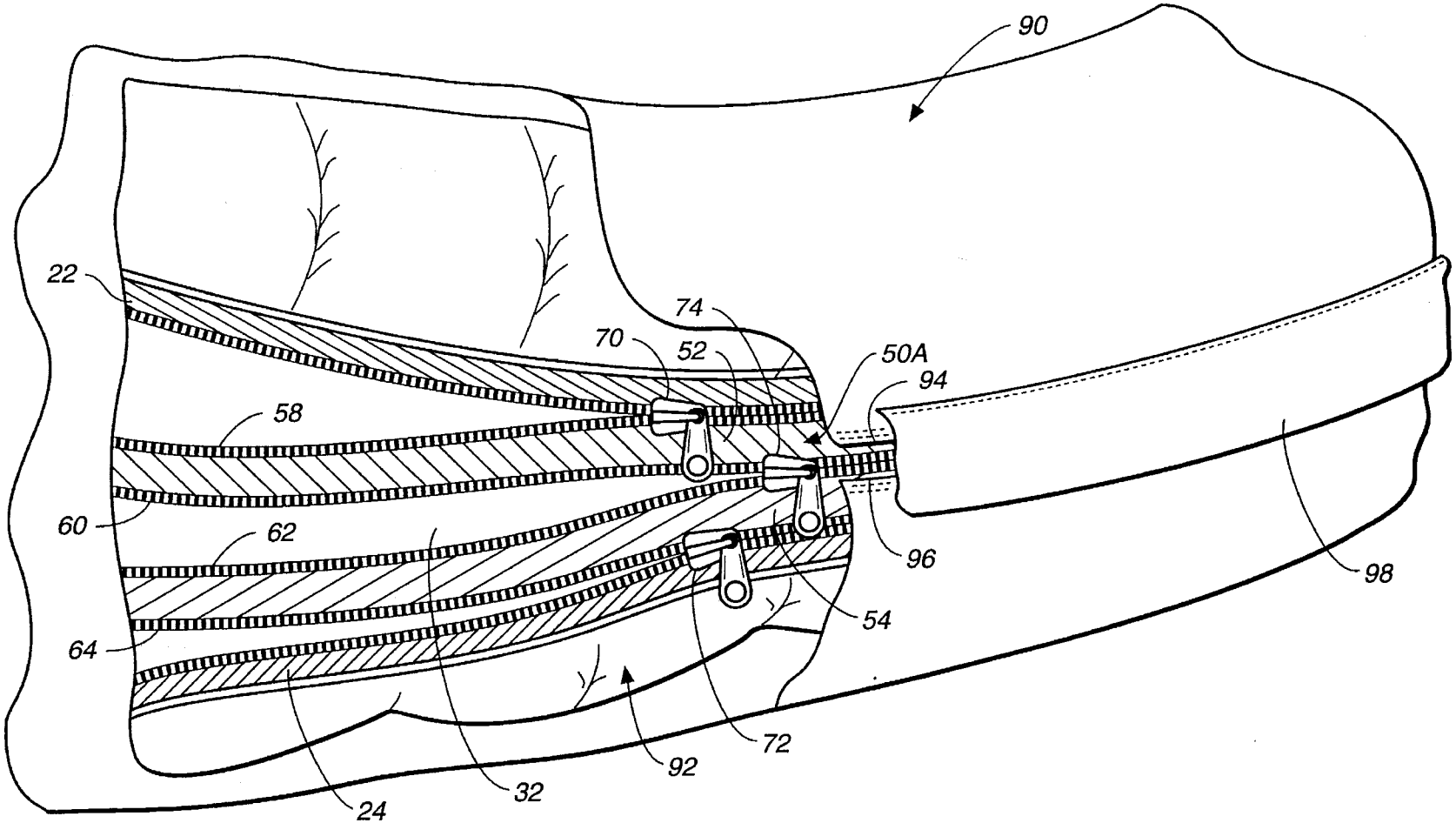
FIG. 10 is an enlarged, perspective view illustrating portions of an inner bag and protective cover constructed in accordance with the teachings of the present invention and illustrating details of a zipper assembly releasably securing a protective cover to an inner bag.

Referring now to FIGS. 9, 9A and 10 the principles of the present invention are utilized to releasably secure a bag cover 90 to and about a bag 92. The bag 92 may be a sleeping bag or a liner bag of the type conventionally utilized to provide an inner lining for a sleeping bag. The protective cover 90 may be formed of any suitable material such as nylon. In the interest of simplicity, the bag illustrated is a sleeping bag of the type illustrated in FIG. 1, for example, and like reference numerals are employed to designate certain components of the bag 92.

In the embodiment of FIGS. 9, 9A and 10, a zipper assembly 50A is attached to bag cover 90. The components of the zipper assembly 50A are identical in construction to those employed in zipper assembly 50 described above and need not be described in detail. FIG. 10 illustrates the specific construction of the zipper assembly 50A and the same reference numerals employed to define the components of previously described zipper assembly 50 are utilized in FIG. 10 in connection with zipper assembly 50A. The zipper assembly 50A is secured to bag 92 in FIG. 10 in precisely the same manner that zipper assembly 50 was applied to sleeping bag 10 by zipper slides 70, 72.

The removable bag cover 90, as is conventional, includes a cover interior having a cover longitudinal opening extending longitudinally along the bag cover, the cover longitudinal opening being defined by first and second spaced elongated liner edges 94, 96. The zipper strips 52, 54 are stitched along these edges to secure the zipper strips and their attached rows of teeth to the bag cover. FIG. 9A shows the entire zipper assembly 50A releasably secured in place on bag 92 by the two outermost rows of cover zipper teeth 58, 64 of the zipper assembly engaging the rows of bag teeth. The innermost rows of cover zipper teeth 60, 62 close the bag and bag cover. A protective flap 98 affixed to the bag cover 90 is employed to cover the zipper assembly 50. If desired, synthetic, frictionally engageable fastener material can be utilized to releasably attach the distal end of the flap to the bag cover.

I claim:

1. In combination:

a sleeping bag defining a bag interior, a bag head opening, and a bag longitudinal opening extending longitudinally along the sleeping bag and communicating with said bag head opening and said bag interior, said bag longitudinal opening being defined by first and second spaced elongated bag edges, said sleeping bag including a first row of bag zipper teeth disposed along said first spaced elongated bag edge and a second row of bag zipper teeth disposed along said second spaced elongated bag edge;

a removable bag liner positioned in said bag interior defining a liner interior having a liner head opening and a liner longitudinal opening extending longitudinally, along the bag liner and communicating with said liner head opening and said liner interior, said liner longitudinal opening being defined by first and second spaced elongated liner edges; and a zipper assembly attached to said bag liner, said zipper assembly including first and second pairs of spaced rows of liner zipper teeth, the first pair of spaced rows of liner zipper teeth secured to said first spaced elongated liner edge and parallel thereto and the second pair of spaced rows of liner zipper teeth secured to said second spaced elongated liner edge and parallel thereto, a first zipper slide slidably disposed on and releasably interconnecting said first row of bag zipper teeth and a row of liner teeth of the first pair of spaced rows of liner teeth, a second zipper slide slidably disposed on and releasably interconnecting said second row of bag zipper teeth and a row of liner teeth of the second pair of spaced rows of liner teeth, and a third zipper slide slidably disposed on and releasably interconnecting adjacent rows of liner teeth of said first and second pairs of spaced rows of liner teeth between the rows of liner teeth releasably interconnected to said rows of bag zipper teeth, said zipper assembly releasably securing said bag liner to said sleeping bag.

2. The combination according to claim 1 wherein said zipper assembly includes first and second elongated liner zipper strips, said first elongated liner zipper strip secured to and extending lengthwise along said first spaced elongated liner edge, and said second elongated liner zipper strip secured to and extending lengthwise along said second spaced elongated liner edge, said first pair of spaced rows of liner zipper teeth being affixed to said first elongated liner zipper strip and said second pair of spaced rows of liner zipper teeth being affixed to said second elongated liner zipper strip.

3. The combination according to claim 2 wherein said first and second elongated liner zipper strips are of rectangular configuration and have parallel, elongated liner zipper strip edges, the spaced rows of zipper liner teeth located at said parallel, elongated liner zipper strip edges.

4. The combination according to claim 3 wherein said first and second elongated liner zipper strips are co-planar and extend between the first and second rows of bag zipper teeth when said zipper assembly secures said bag liner to said sleeping bag to expand the bag interior.

5. The combination according to claim 1 wherein said sleeping bag includes a first bag zipper strip secured to said first elongated bag edge and extending therealong and a second bag zipper strip secured to said second elongated bag edge and extending therealong, said first row of bag zipper teeth connected to said first bag zipper strip and said second row of bag zipper teeth connected to said second bag zipper strip.

6. Apparatus for use in combination with a sleeping bag to contribute to the warmth and comfort of an occupant thereof, the sleeping bag defining a bag interior, a bag head opening, and a bag longitudinal opening extending longitudinally along the sleeping bag and communicating with said bag head opening and said bag interior, said bag longitudinal opening being defined by first and second spaced elongated bag edges, and said sleeping bag including a first row of bag zipper teeth disposed along said first spaced elongated bag edge and a second row of bag zipper teeth disposed along said second spaced elongated bag edge, said apparatus comprising:

a removable bag liner positionable in the bag interior of a sleeping bag defining a liner interior having a liner head opening and a liner longitudinal opening extending longitudinally along the bag liner and communicating with said liner head opening and said liner interior, said liner longitudinal opening being defined by first and second spaced elongated liner edges; and a zipper assembly attached to said bag liner, said zipper assembly including first and second pairs of spaced rows of liner zipper teeth, the first pair of spaced rows of liner zipper teeth secured to said first spaced elongated liner edge and parallel thereto and the second pair of spaced rows of liner zipper teeth secured to said second spaced elongated liner edge and parallel thereto, a first zipper slide for releasably interconnecting a first row of bag zipper teeth and a row of liner teeth of the first pair of spaced rows of liner teeth, a second zipper slide for releasably interconnecting a second row of bag zipper teeth and a row of liner teeth of the second pair of spaced rows of liner teeth, and a third zipper slide for releasably interconnecting adjacent rows of liner teeth of said first and second pairs of spaced rows of liner teeth between the rows of liner teeth for releasable interconnection to said rows of bag zipper teeth, said zipper assembly for releasably securing said bag liner to a sleeping bag.

7. The combination according to claim 6 wherein said zipper assembly includes first and second elongated liner zipper strips, said first elongated liner zipper strip secured to and extending lengthwise along said first spaced elongated liner edge, and said second elongated liner zipper strip secured to and extending lengthwise along said second spaced elongated liner edge, said first pair of spaced rows of liner zipper teeth being affixed to said first elongated liner zipper strip and said second pair of spaced rows of liner zipper teeth being affixed to said second elongated liner zipper strip.

8. The combination according to claim 7 wherein said first and second elongated liner zipper strips are of rectangular configuration and have parallel, elongated liner zipper strip edges, the spaced rows of liner zipper teeth located at said parallel, elongated liner zipper strip edges.

9. The combination according to claim 8 wherein said first and second elongated liner zipper strips are co-planar and extend between the first and second rows of bag zipper teeth when said zipper assembly secures said bag liner to a sleeping bag to expand the bag interior.

10. Apparatus for use in combination with a bag to contribute to the warmth and comfort of an occupant thereof, the bag defining a bag interior, a bag head opening, and a bag longitudinal opening extending longitudinally along the bag and communicating with said bag head opening and said bag interior, said bag longitudinal opening being defined by first and second spaced elongated bag edges, and said bag including a first row of bag zipper teeth disposed along said first spaced elongated bag edge and a second row of bag zipper teeth disposed along said second spaced elongated bag edge, said apparatus comprising:

a removable bag cover positionable about the bag defining a cover interior and having a cover longitudinal opening extending longitudinally along the bag cover, said cover longitudinal opening being defined by first and second spaced elongated cover edges; and a zipper assembly attached to said bag cover, said zipper assembly including first and second pairs of spaced rows of cover zipper teeth, the first pair of spaced rows of cover zipper teeth secured to said first spaced elongated cover edge and parallel thereto and the second pair of spaced rows of cover zipper teeth secured to said second spaced elongated cover edge and parallel thereto, a first zipper slide for releasably interconnecting a first row of bag zipper teeth and a row of cover teeth of the first pair of spaced rows of cover teeth, a second zipper slide for releasably interconnecting a second row of bag zipper teeth and a row of cover teeth of the second pair of spaced rows of cover teeth, and a third zipper slide for releasably interconnecting adjacent rows of cover teeth of said first and second pairs of spaced rows of cover teeth between the rows of cover teeth for releasably interconnection to said rows of bag zipper teeth, said zipper assembly for releasably securing said bag cover to a bag.

11. The combination according to claim 10 wherein said zipper assembly includes first and second elongated cover zipper strips, said first elongated cover zipper strip secured to and extending lengthwise along said first spaced elongated cover edge, and said second elongated cover zipper strip secured to and extending lengthwise along said second spaced elongated cover edge, said first pair of spaced rows of cover zipper teeth being affixed to said first elongated cover zipper strip and said second pair of spaced rows of cover zipper teeth being affixed to said second elongated cover zipper strip.

12. The combination according to claim 11 wherein said first and second elongated cover zipper strips are of rectangular configuration and have parallel, elongated cover zipper strip edges, the spaced rows of cover zipper teeth located at said parallel, elongated cover zipper strip edges.

13. The combination according to claim 12 wherein said first and second elongated cover zipper strips are co-planar and extend between the first and second rows of bag zipper teeth when said zipper assembly secures said bag cover to a bag to expand the bag interior.

14. The combination according to claim 10 additionally comprising a protective flap secured to said cover positionable over said zipper assembly.

* * * * *